United States Patent [19]

Attaway

[11] 4,063,396

[45] Dec. 20, 1977

[54] OMNI-PANEL STRUCTURE

[75] Inventor: Julian J. Attaway, Tucker, Ga.

[73] Assignee: MM Systems Corporation, Tucker, Ga.

[21] Appl. No.: 724,573

[22] Filed: Sept. 20, 1976

[51] Int. Cl.[2] ..... E04B 2/72

[52] U.S. Cl. ..... 52/489; 52/520; 52/545; 52/593

[58] Field of Search ..... 52/235, 474, 478, 479, 52/480, 482, 483, 489, 498, 520, 537, 511, 510, 508, 539, 545, 551, 555, 593

[56] References Cited

U.S. PATENT DOCUMENTS

| | | | |
|---|---|---|---|
| 1,913,342 | 6/1933 | Schaffert | 52/483 X |
| 2,511,074 | 6/1950 | Miller | 52/537 X |
| 2,653,686 | 9/1953 | Routt | 52/489 |
| 2,857,995 | 10/1958 | Boulton | 52/483 X |
| 3,209,503 | 10/1965 | Mostoller | 52/404 |
| 3,703,794 | 11/1972 | Gracon et al. | 52/714 X |
| 3,759,007 | 9/1973 | Thiele | 52/545 X |
| 3,852,933 | 12/1974 | Guzzo | 52/520 X |

FOREIGN PATENT DOCUMENTS

| | | | |
|---|---|---|---|
| 94,929 | 12/1963 | Denmark | 52/593 |
| 1,927,052 | 12/1970 | Germany | 52/235 |
| 1,168,628 | 10/1969 | United Kingdom | 52/582 |

*Primary Examiner*—Leslie Braun
*Attorney, Agent, or Firm*—John B. Armentrout

[57] ABSTRACT

An omni-panel structure is disclosed, wherein a plurality of laterally interspaced longitudinally substantially parallel stringer means are provided, each including longitudinal laterally oppositely projecting means having rear surface areas engaged by leg portions of resilient clips, the clips having tongues projecting from bight portions which interconnect the legs, for the tongues to engage forwardly projecting lips on tongue and groove sheathing members, with the latter longitudinally projecting laterally of the stringer members and covering the stringer members, and also covering those of the clips which are introduced in the regions where the tongues and grooves of the sheathing members are mated.

10 Claims, 5 Drawing Figures

10
11
12
13
18
20
2
3
40
42
50
60

Fig. 2
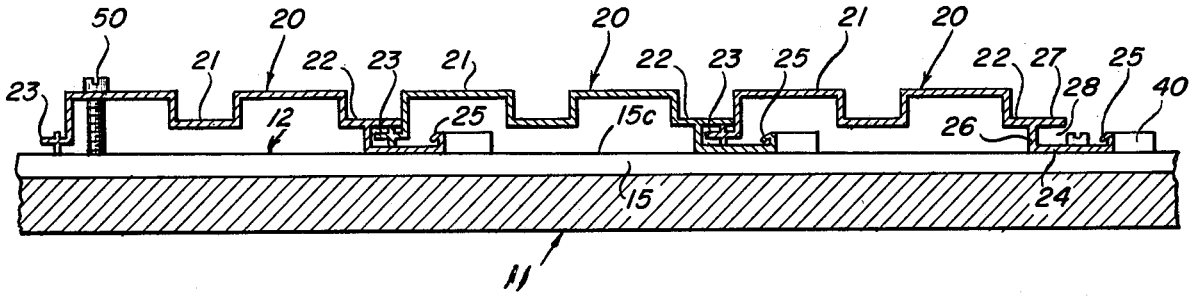
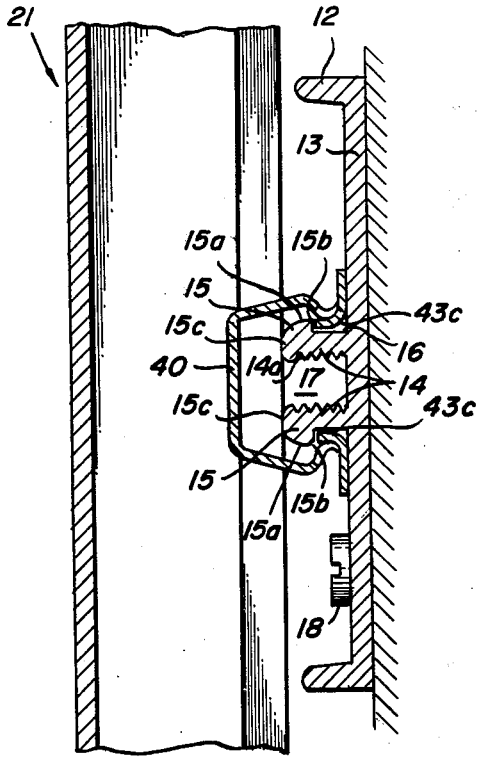
Fig. 3
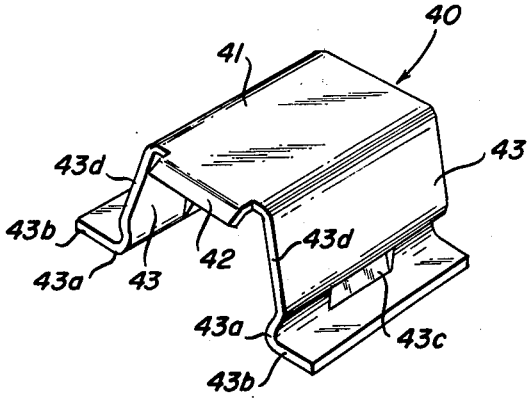
Fig. 4
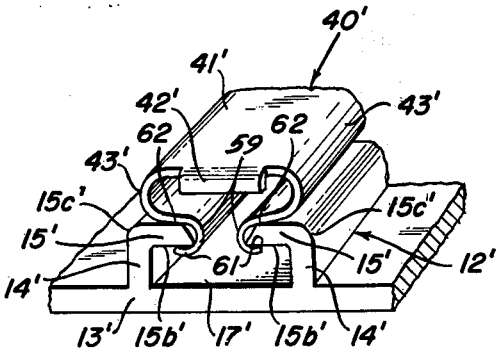
Fig. 5

OMNI-PANEL STRUCTURE

This invention relates to omni-panel structure and more particularly is concerned with improvements in joints and connections in omni-panel structure.

An object of the present invention is to interrelate structurally a plurality of stringer members, sheathing members, and clips, whereby the sheathing members may be readily installed with reference to one another, and with reference to the stringer members, while relying mainly upon the clips for securing the sheathing members to the stringer members in producing an omni-panel structure wherein the stringer members are covered by the sheathing members which also cover the clips from course to course.

Another object of this invention is the provision of omni-panel structure which is practical both from the production standpoint and from the standpoint of reliability when installed.

A further object herein is to achieve at reasonable cost an omni-panel structure wherein joints and connections, which are easy to introduce, contribute importantly to practical aspects of the structure and to reliability of the structure.

Other objects of the present invention in part will be obvious and in part pointed out more fully hereinafter.

In accordance with the present invention, an omni-panel structure is provided having a plurality of laterally interspaced longitudinally substantially parallel stringer means each defining longitudinal laterally oppositely entrant recesses rearwardly in the omni-panel structure and including longitudinal laterally oppositely projecting means having surface areas on the rear thereof bordering the recesses. A plurality of substantially parallel sheathing means in discrete courses are provided forwardly of the stringer means in the omni-panel structure, and the sheathing means in the courses rest against the stringer means and lead longitudinally in the courses laterally of the stringer means. The sheathing means have tongue and groove means engaging the sheathing means from course to course, and the sheathing means in a course which is to be followed by any next of the courses has longitudinal lip means laterally projecting forward in the omni-panel structure, and the lip means thus located is covered by sheathing means in the next of the two courses just mentioned.

Further, in accordance with the present invention, a plurality of resilient clip means are provided, each including bight, leg and tongue means which comprises, bight means, clip tongue means longitudinally projecting from the bight means longitudinally of the bight means, and leg means laterally interconnected by the bight means and having opposing end portions so that the bight means of the plurality of clip means are disposed forwardly of the stringer means in the omni-panel structure and extend laterally of the stringer means, and the end portions of the leg means resiliently engage the rear surface areas of the longitudinal laterally oppositely projecting means of the stringer means and sustain the clip tongue means pressing toward the rear in the omni-panel structure against the lip means of the related course of sheathing means.

With reference to more specific and preferred embodiments of the present invention, represented in the accompanying drawing:

FIG. 2 is a cross section taken in a plane perpendicular to the plane of FIG. 1 at line 2—2;

FIG. 3 is a cross section taken in a plane perpendicular to the plane of FIG. 1 at line 3—3;

FIG. 4 is an isometric view of one of the clips used in the omni-panel structure of FIGS. 1 to 3, inclusive; and FIG. 5 is a detail end sectional view representing a further embodiment, and differing in the respect that modified stringer and clip structure are introduced.

Figure 1:
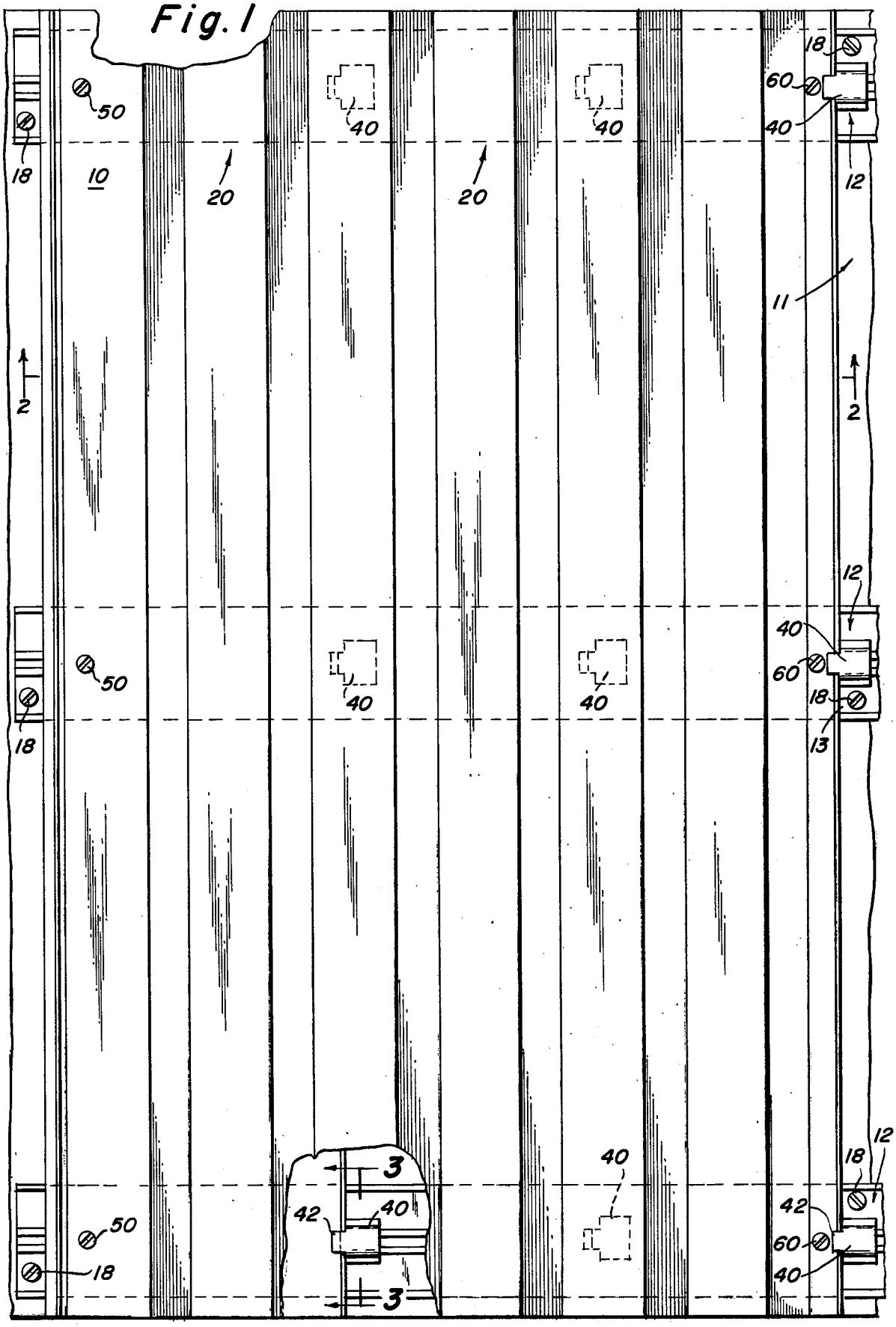
FIG. 1 is a front fragmentary view of an omni-panel structure.

Referring now more particularly to FIGS. 1 to 4 of the accompanying drawing, an omni-panel structure in accordance with the present invention, and designated in general by the reference numeral 10, is provided and represented installed in this particular instance to cover a substrate portion 11 of a building wall, thus to contribute outside facial areas to the building.

A plurality of substantially parallel longitudinal laterally interspaced stringer means of the omni-panel structure 10 are characterized each by including at least one stringer member 12 which in the present embodiment is an extrusion made of an aluminum base alloy or of any other suitable material. A base component 13 (see FIG. 3) of each stringer member 12 is made integral with a pair of longitudinal laterally interspaced intermediate portions 14 and is secured to the substrate 11 by headed fasteners 18 through apertures in the base component, or by any other suitable connecting means. The longitudinal laterally interspaced intermediate portions 14 have a forward lead in the omni-panel structure 10 and thus in a direction away from the base component 13 and carry integrally therewith a pair of longitudinal laterally oppositely outwardly extending projections 15, which from their outer ends 15*a* have rearward faces 15*b* in the omni-panel structure 10. The rearward faces 15*b* extend in longitudinal laterally oppositely entrant recesses 16 in the stringer member 12. The recesses 16 are defined by the base component 13, the pair of intermediate portions 14 and the pair of projections 15 of the base member. A longitudinal groove 17 in the stringer member 12 is laterally entrant between forward faces 15*c* of the pair of projections 15 and extends rearwardly in the omni-panel structure 10 between inner faces of the pair of intermediate portions 14 and terminates at an innermost face formed by the base component 13 of the stringer member 12. Each of the inner faces of the pair of intermediate portions 14 of the stringer member 12 has a plurality of longitudinal laterally interspaced ribs 14*a* inside the longitudinal groove 17 for a purpose hereafter to be described.

It will be understood through referring to FIGS. 1 and 2 that the omni-panel structure 10 is further characterized by comprising a plurality of tongue and groove sheathing members 20 in longitudinal substantially parallel courses, each of the courses being of the width of the sheating member or members 20 in the longitudinal lead of the course. Sheathing members 20 are aluminum base alloy extrusions, through instead they may be of any other suitable material, and each of the sheathing members comprises an intermediate panel wall portion 21 (see FIG. 2) which is integral with groove and longitudinal lateral lip forming structure 22 and a longitudinal lateral tongue 23. A longitudinal lateral lip 25 of the groove and lip forming structure of each sheathing member 20 has a forward lateral lead in the installed condition of the sheathing member in the omni-panel structure 10, and the lip 25 is on a first longitudinal lateral flange 24 which is interconnected by means of a bight wall portion 26 of the sheathing member with a second longitudinal lateral flange 27 of the sheathing member, thus for the flanges 24 and 27, and the bight wall portion 26 to form a longitudinal groove 28 opening laterally of the sheathing member toward the lip 25. Flange 27 in reach laterally of the sheathing member 20 is shorter than the flange 24, accordingly having the lip 25 laterally removed to constitute a laterally outer portion of the sheathing member. The tongue 23 of each of the sheathing members 20 extends to include an opposite lateral edge of the sheathing member.

It will be understood that the sheathing members 20 in the omni-panel structure 10 rest against faces 15*c* of the pairs of projections 15 of the stringer members 12 (see FIGS. 2 and 3) and longitudinally extend transversely of the stringer members in a covering relation to the latter and the building sub-wall structure 11 (see FIG. 1), while the groove 28 of a sheathing member 20 in each of the courses of sheathing members mates with the tongue 23 of a sheathing member 20 in any next such course. Notably, too, in the present arrangement, a sheathing member lip 25, adjacent to a mated tongue 23 and groove 28 offered by sheathing members 20 from course to course, is covered by the intermediate panel wall portion 21 of one of the two thus mated sheathing members, having the lip 25 engaged in a manner hereinafter to be described.

A plurality of resilient clips 40 also are included in the omni-panel structure 10, and the clips are used for fastening the sheathing members 20 in the courses formed by the latter to the stringers 12. The clips 40 are constructed from spring quality sheet metal, such as steel, or of any other suitable material, and further in accordance with the present embodiment the clips 40 are generally U-shaped, each having a pair of legs 43 interconnected by a bight portion 41, from which, at one longitudinal end, a tongue 42 projects angularly inwardly with reference to the bight portion 41, thus forming an obtuse angle with the bight portion 41. Outer portions 43*a* of the legs 43 of the clip 41 are toed-in toward each other so that when the clips 40 are engaged with the stringer members 12 in the omni-panel structure 10, as seen in FIGS. 1, 2 and 3, the bight portions 41 of the clips extend forward and laterally of the stringer members 12. Under the latter conditions the toed-in portions 43*a* of the legs 43 of the several clips 40 resiliently engage the rear faces 15*b* on corresponding pairs of the projections of the stringer members 12 in the omni-panel structure (as seen in FIG. 3) and sustain the clip tongues 42 pressing toward the rear of the omni-panel structure and against the lips 25 of the related sheathing members 20 for holding the sheathing members against the stringer members which are engaged by the clips.

It will be noted that the laterally oppositely inwardly directed toed-in portions 43*a* of the legs 43 of each of the clips 40 are supplemented by the legs having laterally oppositely outwardly directed end portions 43*b* for the laterally oppositely outwardly directed end portions 43*b* to seat upon the base component 13 of any one of the stringer members 12 with which the clip is used, and stop inward movement of the clip 40 when the clip tongue 42 engages a sheathing member lip 25 with the stringer member and thus presses the sheathing member with a first vector of thrust against the stringer member. Tabs 43*c* are struck from the toed-in portions of the legs 43 of at least some of the clips 40 for the tabs 43*c* to bite into the rear faces 15*b* of the pair of projections of the stringer member 12 upon which the clip is seated, the bite being to resist having the clip 40 raised away and thus released from the stringer member. Further, it will be noted that the tongue 42 of each of the clips 40 forms an obtuse angle with the bight portion 41 of the clip and applies a second vector of thrust to the lip 25 of the sheathing member, the latter vector of thrust being toward adjacent edges 43*d* of the legs 43 of the clip for laterally stabilizing a sheathing member 20 as installed. The lip 25 of the sheathing member accordingly is engaged by the tongue 42 and by the adjacent edges 43*d* of the clip legs 43.

In the present embodiment, the stringer members 12 longitudinally lead horizontally and the sheathing members longitudinally lead vertically, and in installing the members it is advantageous to use screws (see FIG. 1) in installing first and last courses of the sheathing members. As shown in FIG. 1 and 2, screws 50 extend through apertures drilled through lefthand portions of a sheathing member or members 20 used in a first course, so as to have the lip 25 and groove 28 of the stringer member disposed to the right and the threads of the screws 50 self-tapped against the ribs 14*a* in the grooves 17 of at least some of the stringer members 12, thus initially to secure the sheathing member or members in the course in place. Resilient clips 40 then are applied for engaging at least some of the stringers 12 by resiliently springing and thus snapping the clips into place to have the tongues 42 thereof against the lip 25 of the sheathing member or members 20 in the first course and press the sheathing member or members in the course against the stringer members engaged by the clip while having the toed-in portions 43*a* of the clip legs 43 engaged with the rear faces 15*b* of the related stringer projections 15 as hereinbefore described. Thereafter, the tongue 23 of one or more additional sheathing members 20 is introduced into the groove 28 of the sheathing member or members 20 in the first course, to constitute an intermediate second course, and the lip 25 of the sheathing member or members 20 in the second course are secured to at least some of the stringers 12 in a manner hereinbefore described with reference to the first course. Additional intermediate courses (not shown) of the sheathing members 20 may be put into place continuing from the second course in a manner involving operations similar to those used for installing the second course. The final course of the sheathing members 20 may, however, include or omit the use of clips 40 against the lip 25 of one or more sheathing members constituting the final course of the sheathing members in favor of the use of screws 60 (see FIG. 1) which enter drill holes provided in the righthand portions of the sheathing member or members 20 in the final course and threadedly are self-tapped against the ribs 14*a* in the grooves 17 in at least some of the stringer members 12 for the screws 60 to secure the righthand portions of the sheathing member or members in the final course in place. It will of course be understood that in certain embodiments the screws 50 associated with the first course may be omitted or retained, and that the screws and clips 40 shown as both being used to secure the final course, may also be omitted or retained, where instead suitably mounted trim or the like (not shown) is used for securing outermost lateral portions of the sheathing members 20 in the first and final courses in place in the omni-panel structure.

In the embodiment represented in FIG. 5, stringer members 12' and resilient clips 40' are substituted for those described in the embodiment of FIGS. 1 to 4. The stringer members 12' are each characterized by having a groove 17' defined by a base component 13', a pair of intermediate portions 14' and a pair of longitudinal laterally oppositely inwardly projecting portions 15' which terminate at the entrance of the groove 17' so as to have rear surfaces 15b' in the groove 17'. Each of the resilient clips 40' includes a bight portion 41', a pair of legs 43' interconnected by the bight portion 41', and a tongue 42' projecting from the bight portion 41' and forming an obtuse angle with the bight portion 41' for engaging the lip 25 of a sheathing member 20 of the type hereinbefore described. The pair of legs 43' of each of the clips 40' include indented portions 59 having end components 61 for engaging the rear surfaces 15b' of any of the stringer members 12' and having rest components 62 for resting upon the forward faces 15c' of any one of the stringer members 12' when the tongue 42' of the clip is properly engaged with a sheathing member lip 25 of the character hereinbefore described, for the tongue 42' to maintain the related sheathing member 20 in place against forward faces 15c' of the stringer member 12' and laterally restrain the sheathing member 20 against edges of the clip legs 43' in a manner hereinbefore described with reference to the clip 40 of FIG. 4.

As the invention lends itself to many possible embodiments and as many possible changes may be made in the embodiments hereinbefore set forth, it will be distinctly understood that all matter described herein is to be interpreted as illustrative and not as a limitation.

I claim:

1. In an omni-panel structure, the combination which includes, a plurality of laterally interspaced longitudinally substantially parallel stringer means each rearwardly in the omni-panel structure defining longitudinal laterally oppositely entrant recesses and including longitudinal laterally oppositely projecting means having surface areas on the rear thereof bordering said recesses; a plurality of courses of substantially parallel sheathing means forwardly of said stringer means in the omni-panel structure and resting against said stringer means and longitudinally leading in said courses transversely of said stringer means, said sheathing means having tongue and groove means engaging said sheathing means in said course with said sheathing means in any next said course, and said sheathing means in said course adjacent to said sheathing means in any next said course having lateral end means including longitudinal lip means laterally projecting forward in the omni-panel structure and said lateral end means covered by said sheathing means in said next course, and a plurality of snap-on resilient clip means each including bight, leg and tongue means which comprises, bight means forwardly in the omni-panel structure from said longitudinal laterally oppositely projecting means of a related one of said stringer means, and beyond a related one of said sheathing means longitudinally of said related one of said stringer means, leg means interconnected by said bight means and having oppositely reaching end portions and longitudinal outer lateral edge structure, said oppositely reaching end portions of said leg means engaging rearwardly in the omni-panel structure said rear surface areas of said longitudinal laterally oppositely projecting means of said related one of said stringer means, and clip tongue means extending from said bight means and beyond said longitudinal outer lateral edge structure of said leg means to apply differently directed vectors of thrust to said lip means of said related one of said sheathing means and thus press said related one of said sheathing means toward the rear in the omni-panel structure against said related one of said stringer means and keep said lateral end means of said related one of said sheathing means against said longitudinal outer lateral edge structure of said leg means, having said oppositely reaching end portions of said leg means resiliently engage rearwardly in the omni-panel structure said rear surface areas of said longitudinal laterally oppositely projecting means of said related one of said stringer means.

2. In an omni-panel structure as set forth in claim 1 wherein said longitudinal laterally oppositely projecting means of at least some of said stringer means oppositely laterally project outwardly having said surface areas thereof on the rear, and those of said clip means correspondingly are each characterized by said leg means thereof having oppositely inwardly reaching end portions for resiliently engaging said rear surface areas of said longitudinal laterally oppositely outwardly projecting means characterizing a related one of said stringer means.

3. In an omni-panel structure as set forth in claim 1 wherein said longitudinal laterally oppositely projecting means of at least some of said stringer means oppositely laterally project inwardly having said surface areas thereof on the rear, and those of said clip means correspondingly are each characterized by said leg means thereof having oppositely outwardly reaching end portions for resiliently engaging said rear surface areas of said longitudinal laterally oppositely inwardly projecting means characterizing a related one of said stringer means.

4. In an omni-panel structure, the combination as set forth in claim 1 wherein at least some of said clip means are stopped by supporting portions of said stringer means, against rearward movement of said clip means in the omni-panel structure, when said oppositely reaching end portions of said leg means resiliently engage said rear surface areas of said longitudinal laterally oppositely projecting means of said stringer means and sustain said clip tongue means pressing toward the rear in said omni-panel structure against said lip means of said sheathing means.

5. In an omni-panel structure, the combination as set forth in claim 1 wherein each of said stringer means includes base means and intermediate means interconnecting said base means with said longitudinal laterally oppositely projecting means, at least some of said stringer means has a longitudinal groove therein entrant of said intermediate means forwardly in the omni-panel structure, and laterally opposed side wall structure afforded by said intermediate means in said groove is adapted for being engaged by the threads of screws, for supplementally fastening at least some of said sheathing means to said stringer means if so desired.

6. In an omni-panel structure, the combination as set forth in claim 1 wherein at least ome of said oppositely reaching end portions of said clip leg means include oppositely laterally directed portions having tabs struck therefrom for said tabs to bite into said rear surface areas of said laterally oppositely projecting means of the related said stringer means so as to resist said oppositely laterally directed portions being raised away from said stringer means.

7. In an omni-panel structure, the combination as set forth in claim 1 wherein said clip tongue means of at least some of said clip means is inclined relatively to said longitudinal outer lateral edge structure of the corresponding said clip means for wedgingly engaging said lip means of a related one of said sheathing means when said lateral end means of said related one of said sheathing means is against said longitudinal outer lateral edge structure of said leg means of said corresponding clip means and said oppositely reaching end portions of said leg means of said corresponding clip means resiliently engage rearwardly in the omni-panel structure said rear surface areas of said longitudinal laterally oppositely projecting means of a related one of said stringer means.

8. In an omni-panel structure, the combination as set forth in claim 1 wherein said oppositely reaching end portions of said leg means of at least some of said clip means include laterally oppositely inwardly directed portions and laterally outwardly oppositely directed end members connected with said laterally oppositely inwardly directed portions for said lateraly oppositely inwardly directed portions to engage said rear surface areas of longitudinal laterally oppositely outwardly projecting means of a related said stringer means and be stopped against movement rearwardly in the omni-panel structure by said laterally oppositely outwardly directed end members against said base means of the related said stringer means.

9. In an omni-panel structure, the combination as set forth in claim 8 wherein at least some of said stringer means has a longitudinal groove therein entrant of said intermediate means forwardly in the omni-panel structure, and laterally opposed side wall structure afforded by said intermediate means in said grooves is adapted for being engaged by the threads of screws, for supplementally fastening at least some of said sheathing means to said stringer means if so desired.

10. In an omni-panel structure, the combination as set forth in claim 1 wherein said clip tongue means of at least some of said clip means forms an obtuse angle open rearwardly in the omni-panel structure with said bight means of the corresponding said clip means and projects beyond said longitudinal outer lateral edge structure of said leg means of the corresponding said clip means, for said clip tongue means, thus angularly disposed relatively to said bight means, to press toward the rear in the omni-panel structure against said lip means of a related one of said sheathing means, and thus press said related one of said sheathing means against a related one of said stringer means, and to keep said lip means of said related one of said sheathing means for said lateral end means of said related one of said sheathing means to be against said longitudinal outer lateral edge structure of said leg means, when said oppositely reaching end portions of said leg means resiliently engage rearwardly in the omni-panel structure said rear surface areas of said longitudinal laterally oppositely projecting means of said related one of said stringer means.

* * * * *